US009609986B2

(12) United States Patent
Dimbylow et al.

(10) Patent No.: US 9,609,986 B2
(45) **Date of Patent: *Apr. 4, 2017**

(54) CLEANING APPLIANCE

(71) Applicant: Dyson Technology Limited, Wiltshire (GB)

(72) Inventors: Stephen Robert Dimbylow, Swindon (GB); Peter David Gammack, Swindon (GB); Patrick Joseph William Moloney, Swindon (GB); David Christopher James Newton, Bristol (GB); James White, Swindon (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/409,838

(22) PCT Filed: Jun. 20, 2013

(86) PCT No.: PCT/GB2013/051618

§ 371 (c)(1),
(2) Date: Dec. 19, 2014

(87) PCT Pub. No.: WO2013/190309

PCT Pub. Date: Dec. 27, 2013

(65) Prior Publication Data

US 2015/0320272 A1 Nov. 12, 2015

(30) Foreign Application Priority Data

Jun. 20, 2012 (GB) ..... 1210941.9

(51) Int. Cl.

| | |
|---|---|
| ***A47L 5/36*** | (2006.01) |
| ***A47L 9/00*** | (2006.01) |
| ***A47L 9/16*** | (2006.01) |

(52) U.S. Cl.
CPC ..... *A47L 5/362* (2013.01); *A47L 5/365* (2013.01); *A47L 9/009* (2013.01); *A47L 9/1625* (2013.01); *A47L 9/1641* (2013.01); *A47L 9/1691* (2013.01)

(58) Field of Classification Search
CPC .... A47L 9/1683; A47L 9/1666; A47L 9/1641; A47L 9/1625; A47L 9/1691;
(Continued)

(56) References Cited

U.S. PATENT DOCUMENTS

| | | | |
|---|---|---|---|
| 1,856,133 | A | 5/1932 | McClatchie |
| 2,621,756 | A | 12/1952 | Senne |

(Continued)

FOREIGN PATENT DOCUMENTS

| | | |
|---|---|---|
| CN | 101849794 | 10/2010 |
| EP | 1 129 657 | 9/2001 |

(Continued)

OTHER PUBLICATIONS

Search Report mailed Oct. 19, 2012, directed to GB Application No. 1210941.9; 1 page.

(Continued)

*Primary Examiner* — Robert Scruggs
(74) *Attorney, Agent, or Firm* — Morrison & Foerster LLP

(57) ABSTRACT

A cleaning appliance of the cylinder type comprises a separating apparatus for separating dirt from a dirt-bearing fluid flow, and a floor-engaging rolling assembly. The separating apparatus comprises a first cyclonic separation unit having a low efficiency cyclone and a second cyclonic separation unit having a plurality of second cyclones. The rolling assembly comprises a main body and a pair of floor-engaging wheels. The main body comprises a recess in which the separating apparatus is received such that when (Continued)

the cleaning appliance is viewed from either side there is no gap between the first cyclonic separation unit and the rolling assembly along at least 50 to 100% of the full length of the low efficiency cyclone.

13 Claims, 15 Drawing Sheets

(58) Field of Classification Search
CPC ..... A47L 9/009; A47L 5/362; A47L 7/0028; A47L 7/0038; A47L 7/0042
See application file for complete search history.

(56) References Cited

U.S. PATENT DOCUMENTS

| | | | | |
|---|---|---|---|---|
| 2,632,524 | A | 3/1953 | Senne | |
| 2,686,330 | A | 8/1954 | Wales | |
| 6,536,073 | B2 | 3/2003 | Uratani et al. | |
| 7,258,714 | B2 | 8/2007 | Genn et al. | |
| 7,867,308 | B2 | 1/2011 | Conrad | |
| 7,958,598 | B2 | 6/2011 | Yun et al. | |
| 8,769,767 | B2 | 7/2014 | Conrad | |
| 9,370,286 | B2 * | 6/2016 | Dimbylow | A47L 5/36 |
| 2005/0066634 | A1 | 3/2005 | Genn et al. | |
| 2006/0213023 | A1 | 9/2006 | Hare et al. | |
| 2007/0094837 | A1 | 5/2007 | Jeon et al. | |
| 2007/0143953 | A1 | 6/2007 | Hwang et al. | |
| 2009/0178236 | A1 * | 7/2009 | Yun | A47L 9/108 15/352 |
| 2009/0241286 | A1 * | 10/2009 | Hwang | A47L 5/365 15/347 |
| 2010/0162517 | A1 * | 7/2010 | Han | A47L 9/1608 15/352 |
| 2010/0242215 | A1 | 9/2010 | Dyson et al. | |
| 2010/0242216 | A1 | 9/2010 | Macnaughton | |
| 2010/0242219 | A1 | 9/2010 | Dyson et al. | |
| 2011/0219577 | A1 | 9/2011 | Conrad | |
| 2012/0036675 | A1 | 2/2012 | Conrad | |
| 2013/0025086 | A1 | 1/2013 | Komae et al. | |
| 2013/0055691 | A1 | 3/2013 | Kim et al. | |
| 2014/0013538 | A1 | 1/2014 | Dyson et al. | |
| 2014/0059797 | A1 | 3/2014 | Kim et al. | |
| 2015/0182086 | A1 | 7/2015 | Dimbylow et al. | |
| 2015/0190025 | A1 | 7/2015 | Dimbylow et al. | |
| 2015/0190026 | A1 | 7/2015 | Dimbylow et al. | |
| 2015/0320271 | A1 | 11/2015 | Dimbylow et al. | |
| 2015/0320272 | A1 | 11/2015 | Dimbylow et al. | |
| 2015/0320273 | A1 | 11/2015 | Dimbylow et al. | |

FOREIGN PATENT DOCUMENTS

| | | |
|---|---|---|
| EP | 1 676 514 | 7/2006 |
| EP | 1 779 761 | 5/2007 |
| EP | 1 842 597 | 10/2007 |
| EP | 1 952 743 | 8/2008 |
| EP | 2 064 981 | 6/2009 |
| EP | 2 201 880 | 6/2010 |
| EP | 2 322 070 | 5/2011 |
| EP | 2 436 290 | 4/2012 |
| FR | 1.310.618 | 10/1962 |
| GB | 645847 | 11/1950 |
| GB | 2 407 022 | 2/2006 |
| GB | 2 454 227 | 5/2009 |
| GB | 2468151 | 9/2010 |
| GB | 2475312 | 5/2011 |
| GB | 2475313 | 5/2011 |
| GB | 2484120 | 4/2012 |
| GB | 2484122 | 4/2012 |
| GB | 2487775 | 8/2012 |
| JP | 5-95859 | 4/1993 |
| JP | 2001-314356 | 11/2001 |
| JP | 2003-93280 | 4/2003 |
| JP | 2006-524062 | 10/2006 |
| JP | 2007-275591 | 10/2007 |
| JP | 2008-183418 | 8/2008 |
| JP | 2009-112811 | 5/2009 |
| JP | 4900520 | 1/2012 |
| JP | 2012-75896 | 4/2012 |
| JP | 2012-106087 | 6/2012 |
| KR | 10-0555321 | 3/2006 |
| KR | 10-0577278 | 5/2006 |
| KR | 10-2011-0131235 | 12/2011 |
| WO | WO-03/068041 | 8/2003 |
| WO | WO-2004/103142 | 12/2004 |
| WO | WO-2008/117945 | 10/2008 |
| WO | WO-2010/097612 | 9/2010 |
| WO | WO-2010/112885 | 10/2010 |
| WO | WO-2010/112887 | 10/2010 |
| WO | WO-2011/096143 | 8/2011 |
| WO | WO-2011/152184 | 12/2011 |

OTHER PUBLICATIONS

International Search Report and Written Opinion mailed Dec. 4, 2013, directed to International Application No. PCT/GB2013/051618; 11 pages.
Dimbylow et al., Office Action mailed Aug. 25, 2015, directed to U.S. Appl. No. 14/409,849; 9 pages.
Dimbylow et al., Office Action mailed Oct. 2, 2015, directed to U.S. Appl. No. 14/409,816; 11 pages.
Dimbylow et al., Office Action mailed Feb. 19, 2016, directed to U.S. Appl. No. 14/409,816; 13 pages.
Dimbylow et al., Office Action mailed Feb. 8, 2016, directed to U.S. Appl. No. 14/409,849; 11 pages.
Dimbylow et al., Office Action mailed Oct. 15, 2015, directed to U.S. Appl. No. 14/409,656; 14 pages.
Dimbylow et al., Office Action mailed Mar. 11, 2016, directed to U.S. Appl. No. 14/409,656; 12 pages.
Dimbylow et al., Office Action mailed Oct. 1, 2015, directed to U.S. Appl. No. 14/409,826; 6 pages.
Dimbylow et al., Office Action mailed Jul. 25, 2016, directed to U.S. Appl. No. 14/409,816; 17 pages.
Dimbylow et al., Office Action mailed Jul. 28, 2016, directed to U.S. Appl. No. 14/409,849; 14 pages.
Dimbylow et al., Office Action mailed Oct. 5, 2016, directed to U.S. Appl. No. 14/409,656; 15 pages.

* cited by examiner

CLEANING APPLIANCE

REFERENCE TO RELATED APPLICATIONS

This application is a national stage application under 35 USC 371 of International Application No. PCT/GB2013/051618, filed Jun. 20, 2013, which claims the priority of United Kingdom Application No. 1210941.9, filed Jun. 20, 2012, the entire contents of which are incorporated herein by reference.

FIELD OF THE INVENTION

The present invention relates to a cleaning appliance and in particular to a cleaning appliance in the form of a vacuum cleaner.

BACKGROUND OF THE INVENTION

Cleaning appliances such as vacuum cleaners are well known. The majority of vacuum cleaners are either of the "upright" type or of the "cylinder" type (called canister or barrel machines in some countries). Cylinder vacuum cleaners generally comprise a main body which contains a motor-driven fan unit for drawing a dirt-bearing air flow into the vacuum cleaner, and separating apparatus, such as a cyclonic separator or a bag, for separating dirt and dust from the air flow. The dirt-bearing air flow is introduced to the main body through a suction hose and wand assembly which is connected to the main body. The main body of the vacuum cleaner is dragged along by the hose as a user moves around a room. A cleaning tool is attached to the remote end of the hose and wand assembly.

For example, GB2407022 describes a cylinder vacuum cleaner having a main body which supports cyclonic separating apparatus. The vacuum cleaner has two main wheels, one on each side of a rear portion of the main body, and a castor wheel located beneath the front portion of the main body which allows the vacuum cleaner to be dragged across a surface.

EP1129657 describes a cylinder vacuum cleaner which is in the form of a spherical body connected to the suction hose and wand assembly. The spherical volume of the spherical body incorporates a pair of wheels, one located on each side of the body, and houses an electric blower for drawing a fluid flow through the cleaner, and a dust bag for separating dirt and dust from the fluid flow.

WO2010/112887 describes a cylinder vacuum cleaner having a generally spherical assembly connected to a chassis for improving the manoeuvrability of the vacuum cleaner over a floor surface. The spherical assembly comprises a body and a pair of dome shaped wheels connected to the body. The separating apparatus is arranged in front of the spherical assembly. The chassis includes a support for supporting the separating apparatus of the vacuum cleaner. The support is located on an inlet duct for conveying a dirt-bearing air flow to the separating apparatus.

SUMMARY OF THE INVENTION

The present invention provides a cleaning appliance of the cylinder type comprising: a separating apparatus for separating dirt from a dirt-bearing fluid flow, the separating apparatus having a first cyclonic separation unit comprising a low efficiency cyclone and a second cyclonic separation unit comprising a plurality of second cyclones; and a floor-engaging rolling assembly comprising a main body and a pair of floor-engaging wheels, wherein the main body comprises a recess in which the separating apparatus is received such that when the cleaning appliance is viewed from either side there is no gap between the first cyclonic separation unit and the rolling assembly along at least 50 to 100% of the full length of the low efficiency cyclone.

As used herein the term "no gap" shall be taken to mean that it is not possible to look between the two components to see through to the other side of the cleaning appliance. Having no gap is advantageous because it means that the separating apparatus and the rolling assembly have been brought very close together. This means that the centre of gravity of the cleaning appliance as a whole is lowered and brought within the bounds of the rolling assembly. Having such a centre of gravity has been found to encourage the cleaning appliance to return to an upright position if it is tipped on to its side.

In a preferred embodiment, when the cleaning appliance is viewed from either side and the separating apparatus is received in the recess, there is no gap between the second cyclonic separation unit and the rolling assembly along at least 50 to 100% of the full length of the second cyclonic separation unit. Again this means that the separating apparatus has been brought even closer into contact with the rolling assembly. Ideally when the cleaning appliance is viewed from either side and the separating apparatus is received in the recess, there is no gap between the separating apparatus and the rolling assembly at all.

When the cleaning appliance is viewed from either side and the separating apparatus is received in the recess, preferably at least one fifth of the width of the low efficiency cyclone may be hidden from view by a portion of the rolling assembly at the point of maximum depth of the recess.

This is advantageous because since a portion of the separating apparatus is still visible as a portion of the outer surface of the cleaning appliance, this allows a user to easily remove and empty the separating apparatus when required. This has been found to be much more user friendly than if the separating apparatus is totally housed within the rolling assembly, such that the rolling assembly has to be disassembled to provide access to the separating apparatus. In a particular embodiment, a portion of the separating apparatus may be transparent so that a user can see any collected dust. Having a transparent portion as a portion of the outer surface of the cleaning appliance will therefore allow a user to be able to see any collected dust. This will therefore alert a user as to when they need to empty the separating apparatus.

In a preferred embodiment when the cleaning appliance is viewed from either side and the separating apparatus is received in the recess, at least two fifths of the width of the low efficiency cyclone is hidden from view by a portion of the rolling assembly at the point of maximum depth of the recess. In a most preferred embodiment when the cleaning appliance is viewed from either side and the separating apparatus is received in the recess, at least one half of the width of the low efficiency cyclone is hidden from view by a portion of the rolling assembly at the point of maximum depth of the recess. In a particular embodiment when the cleaning appliance is viewed from either side and the separating apparatus is received in the recess, a portion of the second cyclonic separation unit is hidden from view by a portion of the rolling assembly at the point of maximum depth of the recess.

In a particularly preferred embodiment the cleaning appliance may be arranged so that it is urged to return to an upright position if it is tipped onto its side. This may be achieved by ensuring that the centre of gravity of the separating apparatus is a low as possible. In a most preferred embodiment the cleaning appliance is a self-righting cleaning appliance. This means that if the cleaning appliance is tipped onto a side or rear surface it will automatically self right back to an upright position.

The wheels are arranged one on each side of the main body. Each wheel may have a rim which is preferably substantially flush with the respective adjoining portion of the main body of the rolling assembly so that the rolling assembly may have a relatively continuous outer surface which can improve maneuverability of the cleaning appliance. During use, the cleaning appliance may be pulled along a surface in an upright position such that it runs along the surface on the rims of the wheels.

Most preferably each wheel has a domed or generally domed outer surface. As used herein the term "domed" shall be taken to mean that the wheel has a curved side surface. Most preferably the wheels are substantially hemispherical in shape or form a portion of a hemisphere. The wheels could of course have a stepped outer surface or have one or more flat portions whilst still being considered dome shaped as long as together with the main body they form a rolling assembly.

As used herein the term "rolling assembly" is intended to cover an assembly which can roll on its side or rear surfaces when the cleaning appliance is tipped over from an upright position. It does not therefore cover an assembly which only incorporates standard wheels. Such standard wheels will allow the cleaning appliance to run along a surface in an upright position but will not allow the cleaning appliance to roll on its side surfaces if it is tipped over. The term "rolling" does not therefore cover the standard movement of wheels running on their rim, tyre or running edge.

The majority of the external and/or visible surfaces of the rolling assembly are therefore preferably rounded, curved or generally curved such that the overall shape of the rolling assembly appears substantially spheroidal or spherical in shape. This shape allows the cleaning appliance to roll on the curved surfaces.

Allowing the cleaning appliance to roll on its side and rear surfaces during use has been found to be very advantageous. This is because the cleaning appliance does not get stuck on its side when it tips over which is what happens when a cleaning appliance with standard wheels tips onto its side. With this invention a user can continue to use the cleaning appliance once it has tipped over and due to the pulling and turning forces applied to the cleaning appliance during continued use, the cleaning appliance is more able to roll back into its upright position.

The recess and any other surface features of the main body, for example a handle, a plug collar and a flat base surface on the main body, do not detract from the fact that the main body and wheels together as a whole are considered to be a rolling assembly. In fact the rolling assembly may have a number of protrusions, recesses, cut outs or flat portions and still be considered to be substantially spherical or spheroidal and a rolling assembly within the meaning of the term "rolling assembly". This will be the case as long as the overall external appearance of the rolling assembly can be considered generally spherical or spheroidal such that the cleaning appliance could roll if tipped onto its side or rear surfaces. Even with the recess the rolling assembly is considered to be generally spheroidal since its overall appearance is of a spheroid, sphere or ball into which a separating apparatus can be received.

The rotational axes of the wheels may be inclined upwardly with respect to a floor surface upon which the cleaning appliance is located so that the rims of the wheels engage the floor surface when the cleaning appliance is in an upright position. The angle of the inclination of the rotational axes is preferably in the range from 0 to 15°, more preferably in the range from 3 to 8°. This advantageously improves the stability of the cleaning appliance.

The first cyclonic separation unit may be arranged upstream of the second cyclonic separation unit. Preferably the first cyclonic separation unit also comprises a dust collector which may be formed integrally with the low efficiency cyclone. The second cyclonic separation unit may be more efficient than the first cyclonic separation unit.

The plurality of second cyclones may be divided into at least a first set of second cyclones and a second set of second cyclones. The fluid inlets of the first set of cyclones may be arranged in a first group and the fluid inlets of the second set of cyclones may be arranged in a second group spaced along said axis from the first group.

Separating the cyclones of the second cyclonic separation unit into first and second sets which are each arranged about a common axis and have fluid inlets grouped together can allow the sets of cyclones to be spaced along the axis. This can enable both the number and the size of cyclones of the second cyclonic separation unit to be chosen for optimized separation efficiency and cleaning efficiency within the dimensional constraints of the separating apparatus. The provision of a common dust collector for each of the sets of cyclones can facilitate emptying and cleaning of the second cyclonic separating unit.

The fluid inlets of the sets of cyclones may be arranged in one of a number of different arrangements. For example, the inlets may be arranged in helical arrangements extending about the axis. Preferably, the first group of fluid inlets is generally arranged in a first annular arrangement, and the second group of fluid inlets is generally arranged in a second annular arrangement spaced along said axis from the first annular arrangement. Each of these annular arrangements is preferably substantially orthogonal to the axis. The annular arrangements are preferably of substantially the same size. Within each annular arrangement, the fluid inlets are preferably located substantially within a common plane. Alternatively, the fluid inlets may be located in a number of different planes which are each preferably substantially orthogonal to said axis.

The separating apparatus is preferably removably received in the recess such that it can be removed for emptying. The recess therefore provides a support for the separating apparatus on the main body of the rolling assembly. When it is received in the recess the longitudinal axis of the separating apparatus is preferably inclined at an acute angle to the vertical when the appliance moves along a substantially horizontal surface. This angle is preferably in the range of from 0, or 20, or 30, or 35, or 40, or 45 to 50, or 55, or 60, or 65 or 70°. The separating apparatus is preferably located in the recess by lowering it into the recess from above until it docks within the recess.

BRIEF DESCRIPTION OF THE DRAWINGS

Preferred features of the invention will now be described, by way of example only, with reference to the accompanying drawings, in which.

DETAILED DESCRIPTION OF THE INVENTION

Figure 1:
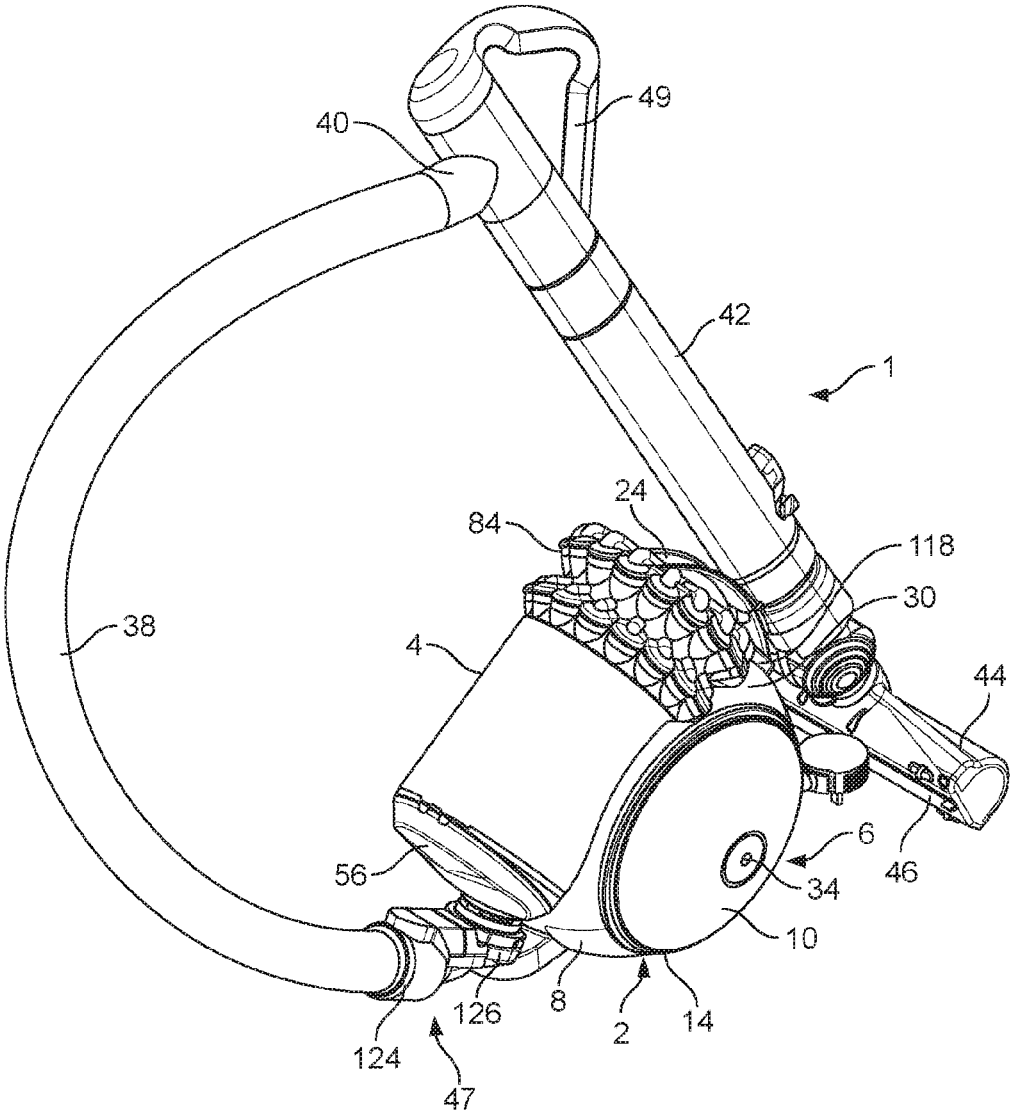
FIG. 1 is a front perspective view, from above, of a vacuum cleaner.

FIG. 1 illustrates an external view of a cleaning appliance in the form of a vacuum cleaner 1. The vacuum cleaner 1 is of the cylinder or canister type which typically has a body 2 which is pulled behind a hose and wand assembly during use. FIGS. 2 to 6 show more detail of the body 2.

The body 2 comprises a separating apparatus 4 for separating dirt and dust from an airflow. The separating apparatus 4 is preferably in the form of cyclonic separating apparatus. The separating apparatus 4 is received within a floor-engaging rolling assembly 6 such that it is at least partially nested or docked within the rolling assembly 6.

The separating apparatus 4 is removable from the rolling assembly 6 such that any dirt collected by the separating apparatus 4 may be emptied.

The rolling assembly 6 comprises a main body 8 and two wheels 10, 12. The two wheels 10, 12 are for engaging with a floor surface and are rotatably connected one on each side of the main body 8. During use the vacuum cleaner 1 can be pulled along and will run on the edges 14 of the wheels 10, 12.

The majority of the external and/or visible surfaces of the rolling assembly 6 are rounded, curved or generally curved such that the overall shape of the rolling assembly 6 appears substantially spheroidal or spherical in shape. This shape allows the vacuum cleaner 1 to roll on the curved surfaces during use of the vacuum cleaner 1. This may happen if, for example, the vacuum cleaner 1 is tipped onto its side, or tipped backwards. In the embodiments shown a curved surface 16 of the main body 8 is positioned towards the rear of the rolling assembly 6. This means that if the vacuum cleaner 1 is tipped backwards during use it can roll on the curved surface 16. The wheels 10 and 12 are positioned one on each side of the rolling assembly 6 such that if the vacuum cleaner 1 is tipped onto its side during use it can roll on the respective wheel 10, 12.

Figure 2:
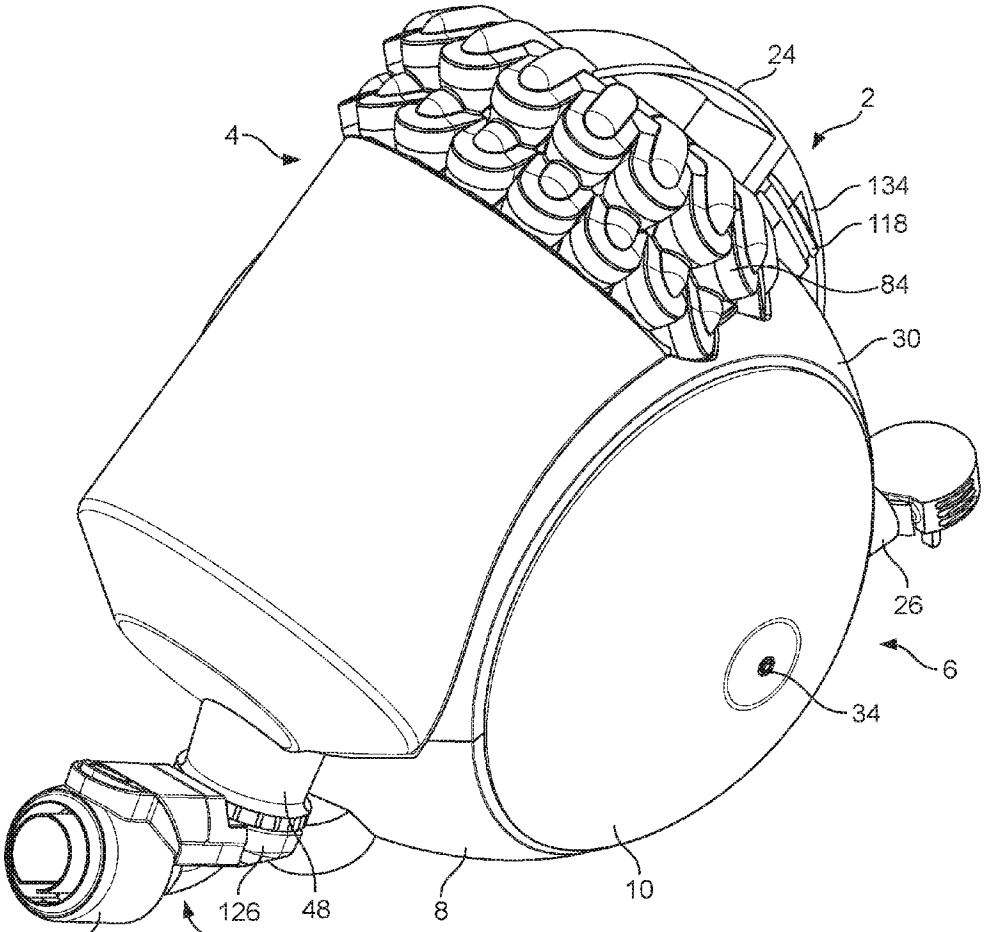
FIG. 2 is a front perspective view of the body of the vacuum cleaner.
Figure 3:
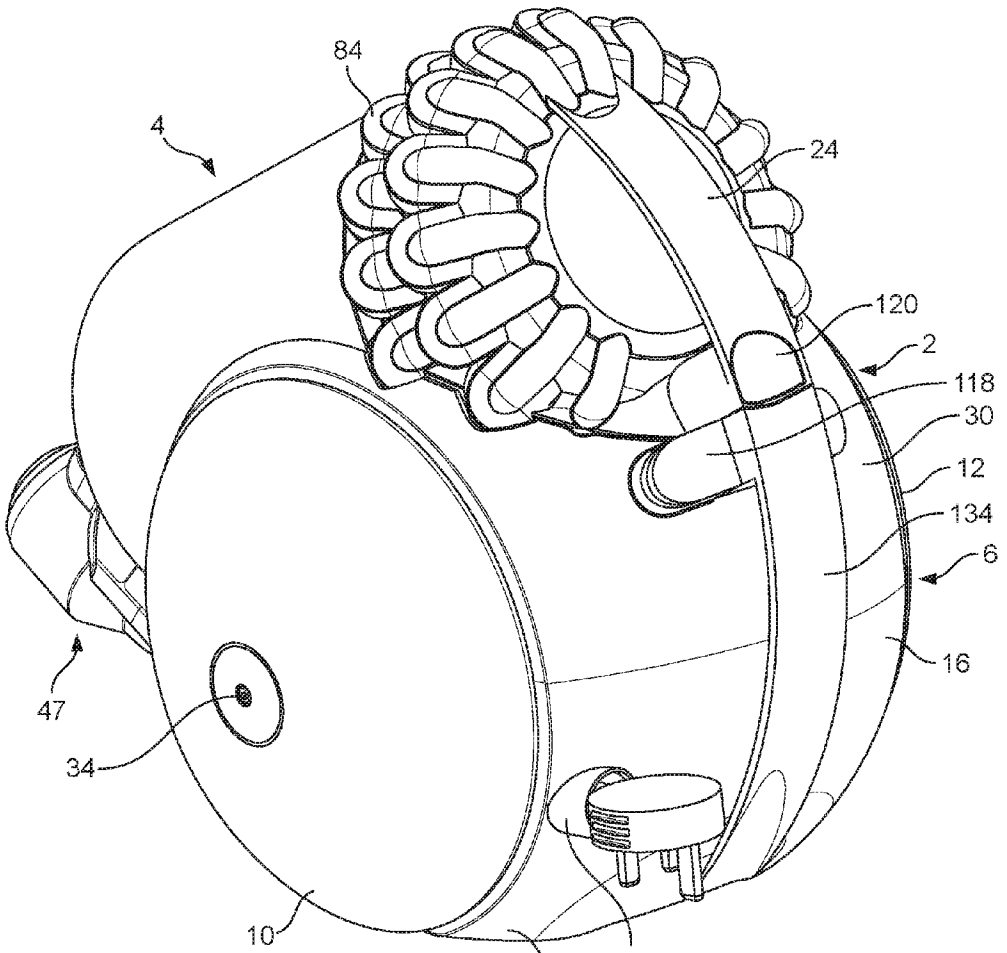
FIG. 3 is a rear perspective view of the body of the vacuum cleaner.

Most preferably the vacuum cleaner 1 is designed such that it is also urged to return to the upright position shown in FIGS. 1 to 3, if it is tipped onto one or more of the curved surfaces of the rolling assembly 6 during use. This may be achieved by ensuring that the centre of gravity of the vacuum cleaner 1 is a low as possible.

Figure 7:
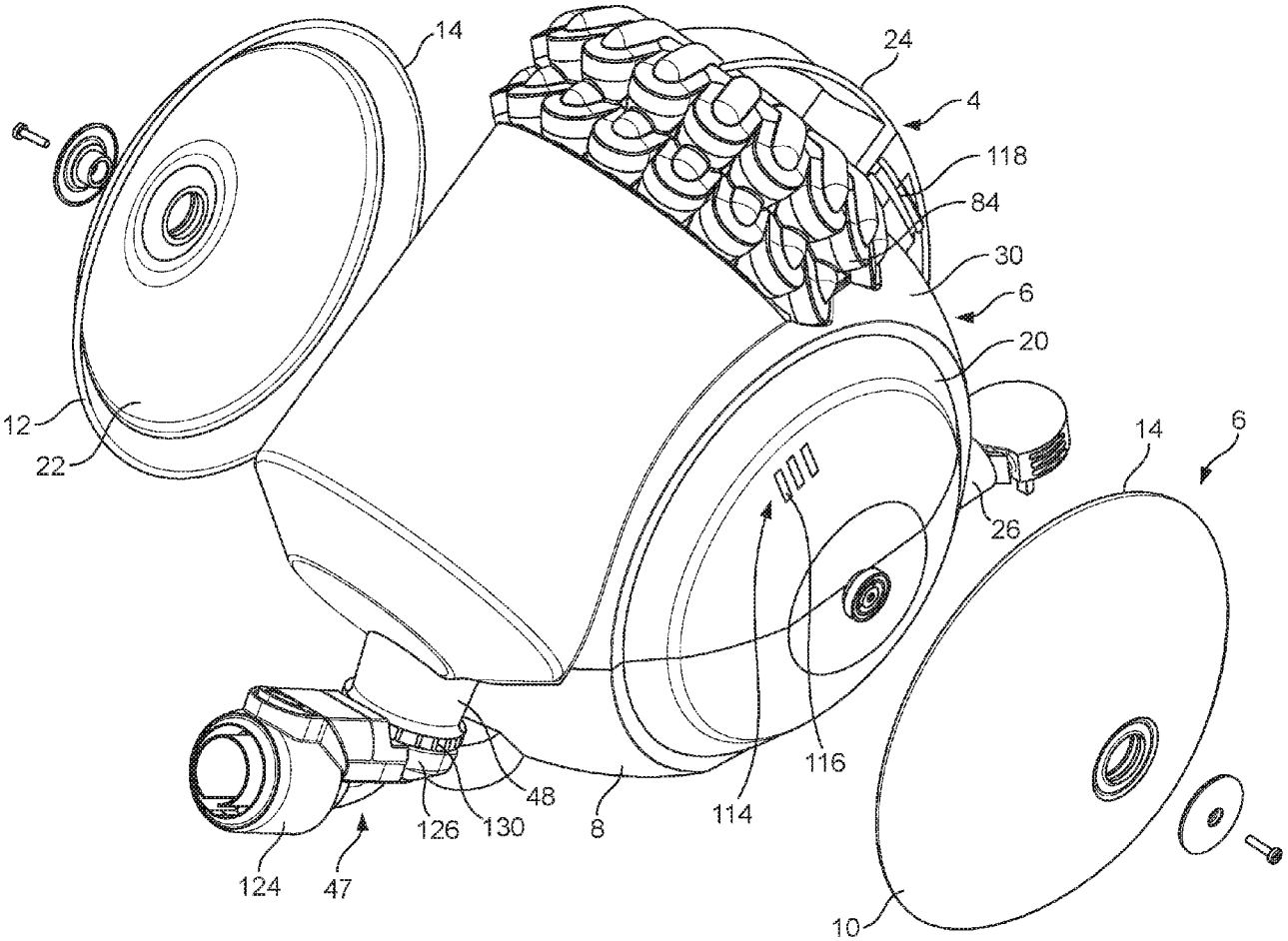
FIG. 7 is a front perspective view, from above of the main body with the wheels removed.
Figure 8:
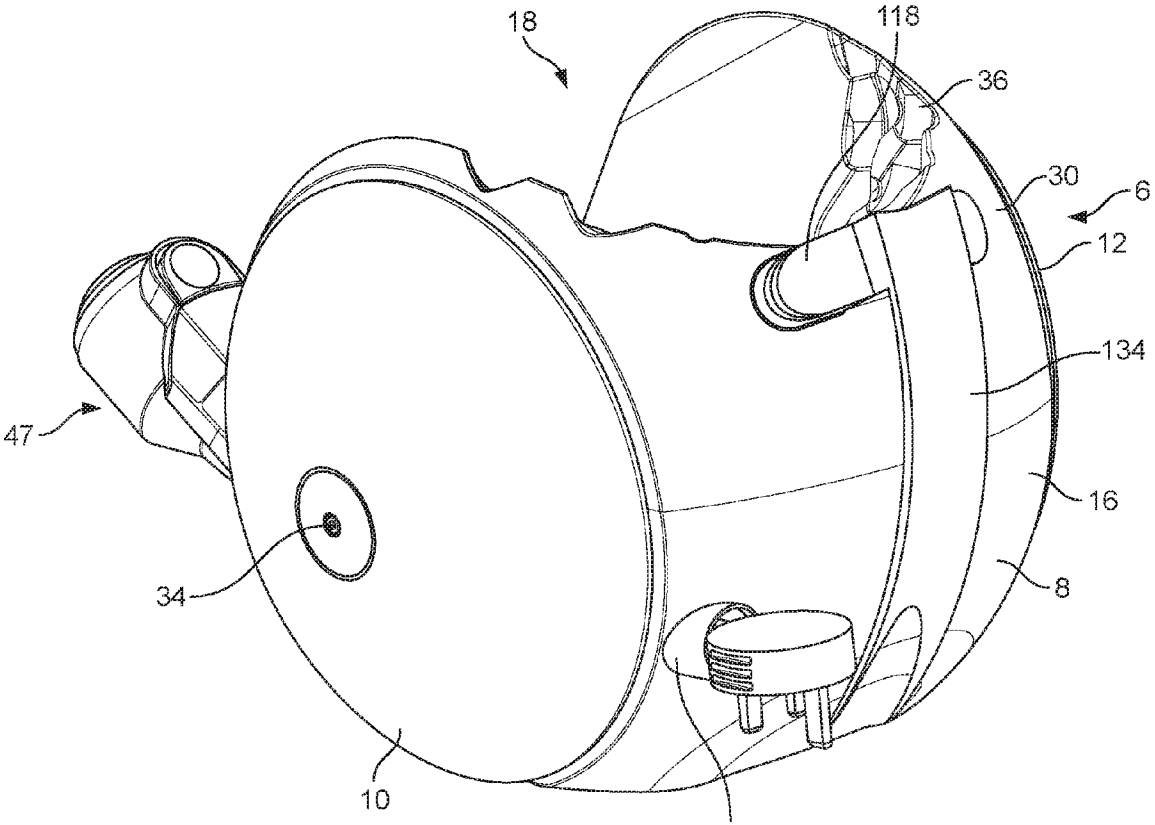
FIG. 8 is a rear perspective view of the body of the vacuum cleaner with the separating apparatus removed.
Figure 9:
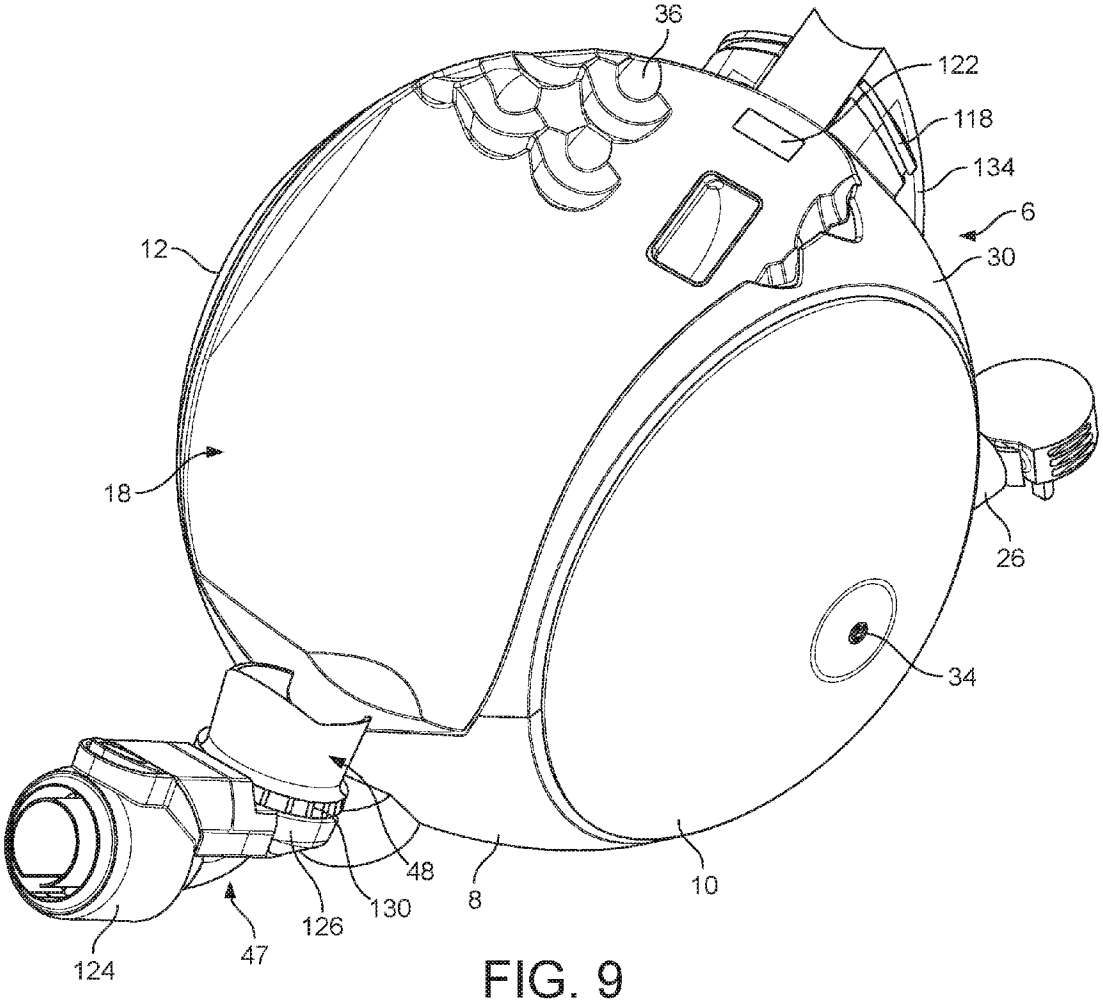
FIG. 9 is a front perspective view of the body of the vacuum cleaner with the separating apparatus removed.
Figure 10:
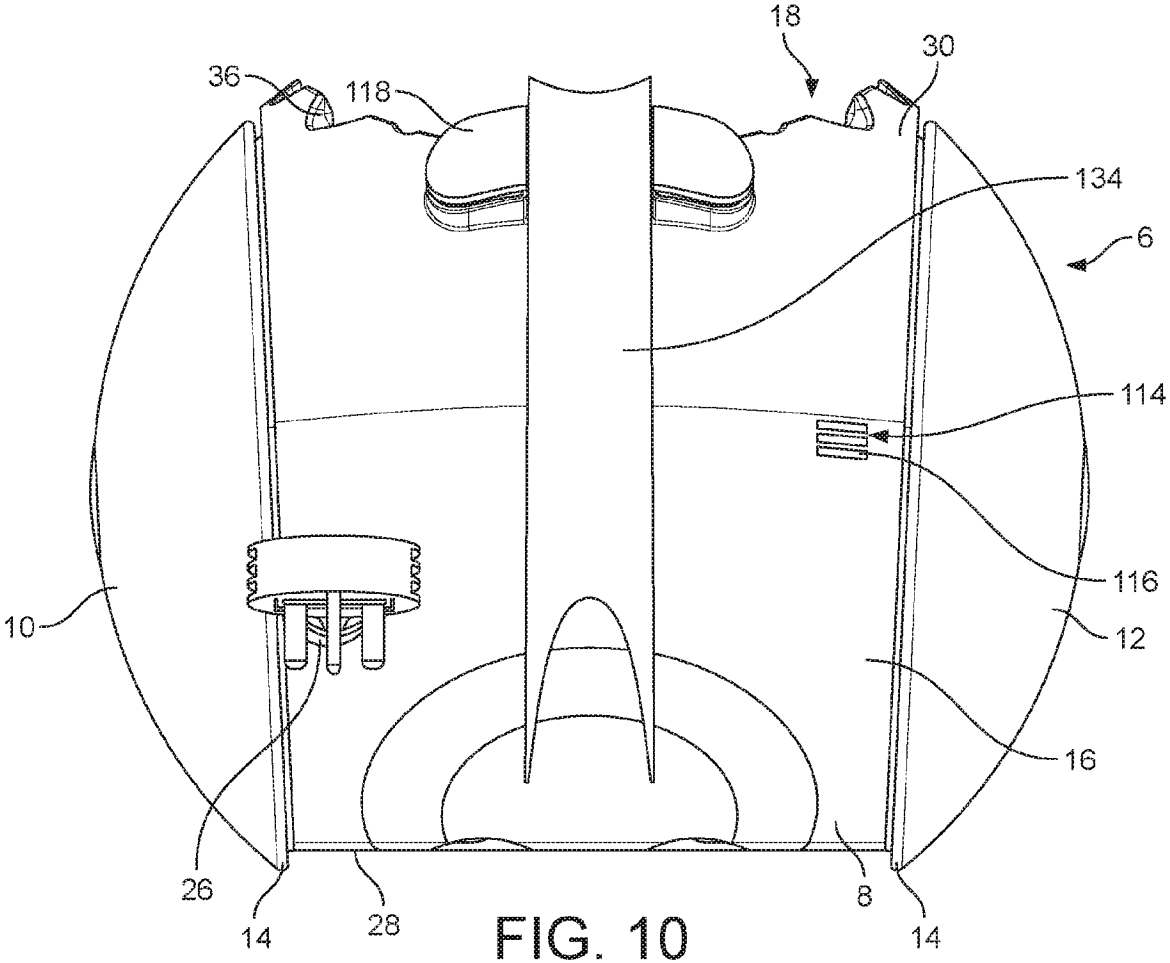
FIG. 10 is a rear view of the body of the vacuum cleaner with the separating apparatus removed.

FIG. 7 shows an exploded view where the wheels 10, 12 have been removed. FIGS. 8 to 10 show views of the rolling assembly 6 where the separating apparatus 4 has been removed. It can be seen that each wheel 10, 12 of the rolling assembly 6 is substantially hemispherical in shape or forms a portion of a hemisphere. The wheels 10, 12 are dome shaped or generally dome shaped. The wheels 10, 12 could of course have a stepped outer surface or have one or more flat portions whilst still being substantially hemispherical in shape and still together with the main body 8 forming a rolling assembly 6 which is substantially spherical or spheroidal in shape.

It can be seen that the side surfaces 20 of the rolling assembly 6 which are underneath the wheels 10, 12, and therefore would be hidden during use of the vacuum cleaner 1, are rounded or curved such that they project towards the inner surface 22 of the wheels 10, 12. This provides the maximum space inside the main body 8 in which to locate components of the vacuum cleaner 1. This feature is of course not essential and the side surfaces 20 could be flat, stepped or shaped in some other way such that they do not follow the contours of the inner surface 22 of the wheels 10, 12.

In these Figures it can be seen that the rolling assembly 6 has a generally spheroidal outer surface on which the vacuum cleaner 1 could roll during use of the vacuum cleaner 1. It can also be seen that the main body 8 has a recess 18 which can accommodate at least part of the separating apparatus 4. The recess 18 and other surface features of the main body 8 such as the handle 24, the plug collar 26 and the flat base surface 28 on the main body 8, do not detract from the fact that the rolling assembly 6 as a whole is substantially spheroidal. In fact the rolling assembly 6 may have a number of protrusions, cut outs or flat portions and still be considered to be substantially spherical or spheroidal and a rolling assembly 6 within the meaning of this application. This will be the case as long as the overall external appearance of the rolling assembly 6 can be considered generally spherical or spheroidal. Even with the recess 18 the rolling assembly 6 is considered to be generally spheroidal since its overall appearance is of a spheroid, sphere or ball with a separating apparatus 4 docked into it.

The rotational axes of the wheels 10, 12 are inclined upwardly with respect to a floor surface upon which the vacuum cleaner 1 is located so that the edges 14 of the wheels 10, 12 engage the floor surface. The angle of the inclination of the rotational axes of the wheels 10, 12 is preferably in the range from 0 to 15°, more preferably in the range from 6 to 10°, and in this embodiment is around 3°. In an alternative embodiment the rotational axes of the wheels may be horizontal.

When the separating apparatus 4 is received in the rolling assembly 6, the longitudinal axis of the separating apparatus 4 is inclined such that it lies at an angle in the range from 0 to 60° from vertical. This arrangement allows the separating apparatus 4 to be docked simply by lowering the separating apparatus 4 onto the rolling assembly 6 from above. In this respect the rolling assembly 6 does not extend around any upper surfaces of the separating apparatus 4, when the separating apparatus 4 is received within the rolling assembly 6. It can be seen that the most rearward point 32 of the separating apparatus 4 is arranged in line with or rearward of the line L, which runs vertically through the centre point 34 of the wheels 10, 12. Preferably further components of the separating apparatus 4 are also arranged rearward of line L. This will be discussed in more detail later.

It can be seen that when the separating apparatus 4 is received in the rolling assembly 6 a portion of the separating apparatus 4 remains visible and forms a part of the outer surface of the vacuum cleaner 1. The size and depth of the recess 18 may vary but will be sized to accommodate the desired size of separating apparatus 4. In the embodiment shown in the Figures, the separating apparatus 4 is received within the recess 18, such that when the vacuum cleaner 1 is viewed from the side there is no gap visible between the separating apparatus 4 and the rolling assembly 6. This side view can be seen best in FIG. 4. In the embodiments shown in the Figures, it can be seen that the separating apparatus 4 is received within the rolling assembly 6 along a major portion of its length. Ideally the separating apparatus 4 is received within the rolling assembly 6 along at least 50% of its length. In a most preferred embodiment the separating apparatus 4 is received within the rolling assembly 6 along at least 90% of its length.

In FIGS. 8, 9 and 10 it can be seen that the recess 18 comprises a number of shaped recesses 36. The shaped recesses 36 are shaped to accommodate correspondingly shaped portions of the separating apparatus 4, such that the separating apparatus 4 can be received closely within the recess 18. This is because the contours of the recess 18 and shaped recesses 36 closely match the external shape of the portion of the separating apparatus 4 which is received within the recess 18 and recesses 36. These shaped recesses 36 will be discussed in more detail later.

Returning to FIG. 1 the vacuum cleaner 10 comprises a flexible hose 38 extending between the body 2 and a swivel coupling 40 for connection to a wand assembly 42. The wand assembly 42 is connected to a cleaner head 44 comprising a suction opening 46 through which a dirt-bearing airflow is drawn into the vacuum cleaner 1. The flexible hose is connected to the body 2 by way of a swivel joint 47 which joins with an inlet duct 48. The inlet duct 48 connects with a dirty air inlet duct 70 which carries dirty air from the inlet duct 48 into the separating apparatus 4. The swivel joint 47 will be discussed in more detail later. The cleaner head 44, hose 38 and wand assembly 42 are omitted from the remaining figures for clarity purposes only.

To maneuver the vacuum cleaner 1 over the floor surface, the user holds and moves a wand handle 49, which via its connection to the hose 38, the wand assembly 42, the swivel coupling 40 and the swivel joint 47 causes the vacuum cleaner 1 to be dragged over the floor surface. This in turn causes the wheels 10, 12 of the rolling assembly 6 to rotate and move the vacuum cleaner 1 over the floor surface.

Figure 11:
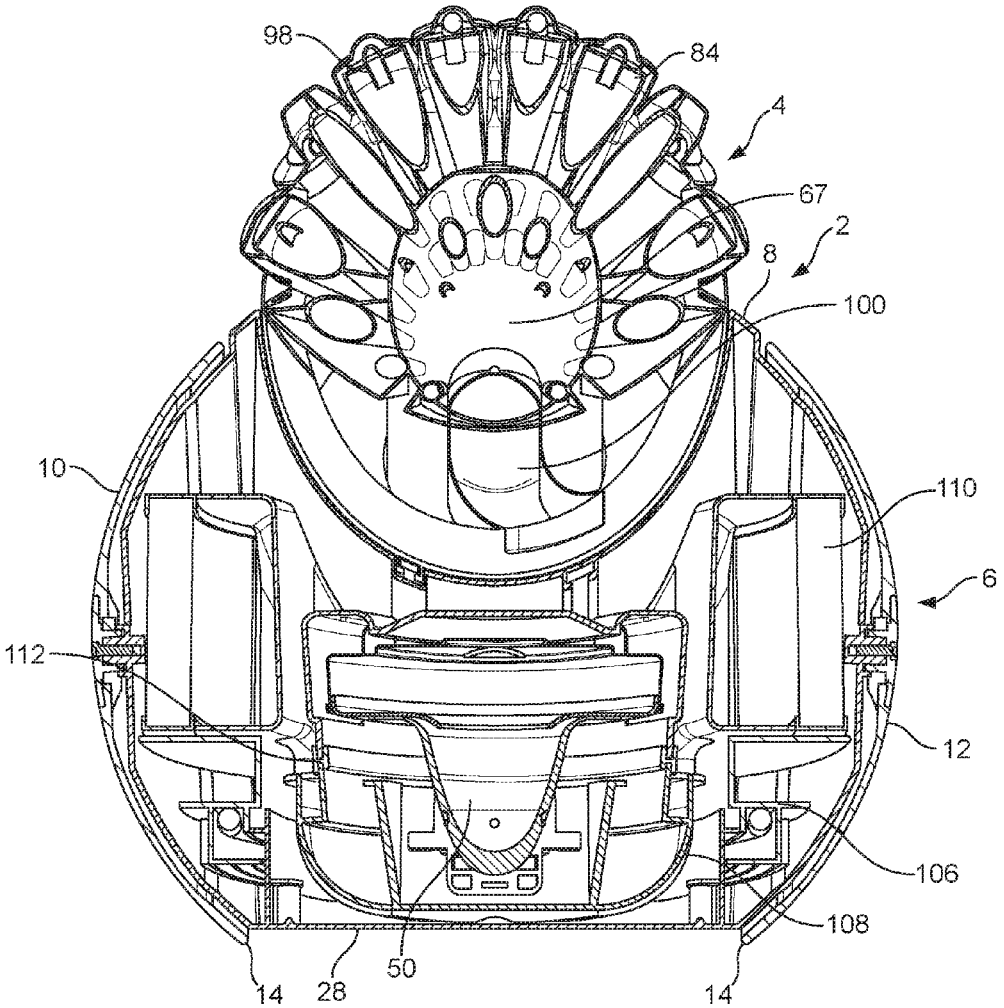
FIG. 11 is a section through a rear view of the body of the vacuum cleaner.
Figure 12:
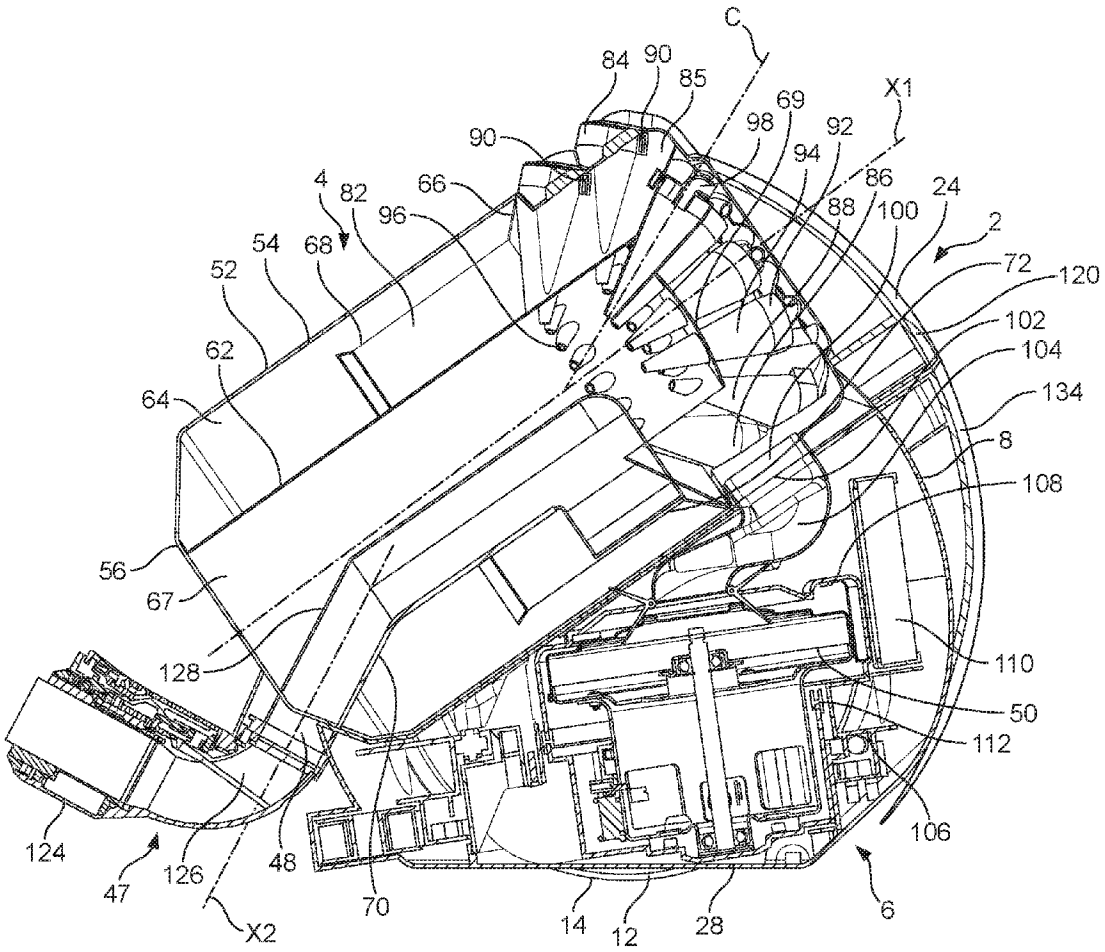
FIG. 12 is a section through a side view of the body of the vacuum cleaner.

As can be seen in FIGS. 11 and 12, a suction source 50 for drawing air from the cleaner head 44 to the separating apparatus 4 is mounted within the main body 8 at a location below the separating apparatus 4. Since the suction source 50 is relatively heavy, locating it below the separating apparatus 4 provides a relatively low centre of gravity for the vacuum cleaner 1. As a result, the stability of the vacuum cleaner 1 is improved. Additionally, handling and maneuvering of the vacuum cleaner 1 are made easier. Preferably the suction source 50 and/or the other components of the vacuum cleaner 1 are arranged such that the vacuum cleaner 1 will be urged to return to the upright position shown in FIGS. 1 to 3, if it is tipped onto one or more of the curved surfaces of the rolling assembly 6 during use. This may be achieved by ensuring that the body 2 has a low centre of gravity.

Figure 13:
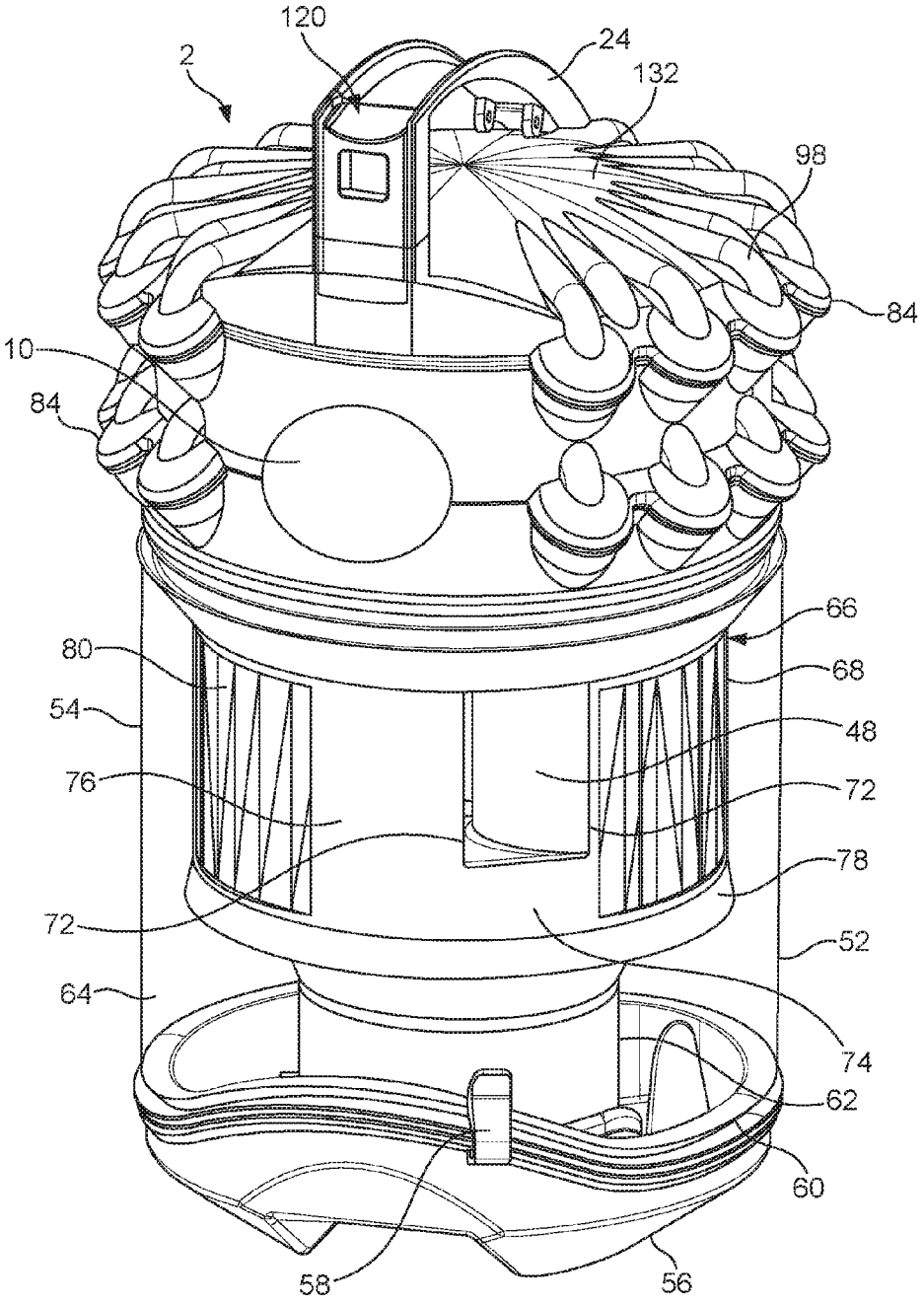
FIG. 13 is a perspective view of the separating apparatus.

The separating apparatus 4 will now be described in more detail with reference to FIGS. 11, 12 and 13. The separating apparatus 4 is a cyclonic separating apparatus. It comprises an outer bin 52 having an outer wall 54 which is substantially cylindrical in shape. The lower end of the outer bin 52 is closed by base 56 which is pivotably attached to the outer wall 54. The base 56 is held in a closed position by a catch 58 which engages a lip 60 located on the outer wall 54. In the closed position, the base 56 is sealed against the lower end of the outer wall 54. The catch 58 is resiliently deformable so that, in the event that the separating apparatus 4 has been removed from the rolling assembly 6 for emptying, that downward pressure applied to the uppermost portion of the catch 58 will move it away from the lip 60 and become disengaged therefrom. In this event, the base 56 will drop away from the outer wall 54.

The specific overall shape of the cyclonic separating apparatus 4 can be varied according to the size and type of vacuum cleaner 1 in which the separating apparatus 4 is to be used. For example, the overall length of the separating apparatus 4 can be increased or decreased with respect to the diameter of the apparatus, or the shape of the base 56 can be altered so as to be, for example, flat or generally frustroconical.

The separating apparatus 4 further comprises a second cylindrical wall 62. The second cylindrical wall 62 is located radially inwardly of the outer wall 54 and spaced therefrom so as to form an annular chamber 64 therebetween. The second cylindrical wall 62 meets the base 56 (when the base 56 is in the closed position) and is sealed thereagainst. A cylindrical chamber 67 is delimited by the second cylindrical wall 62, the base 56 and a chassis 69. The annular chamber 64 is delimited generally by the outer wall 54, the second cylindrical wall 62, the base 56 an upper wall 66 positioned at the upper end of the outer bin 52 and a horseshoe shaped shroud 68 which forms a fluid outlet from the annular chamber 64.

The dirty air inlet duct 70 provides a passageway through the cylindrical chamber 67 for carrying dirty air from the inlet duct 48 to the upper end of the outer bin 52 and receives a dirty airflow from the cleaner head 44 via the hose 38 and wand assembly 42.

The end 72 of the inlet duct 48 is in fluid communication with the annular chamber 64. In a particular embodiment the end 72 of the inlet duct 48 is formed in a wall portion 74 which is attached to the shroud 68. The end 72 of the inlet duct 48 is arranged tangentially to the outer bin 52 so as to ensure that incoming dirty air is forced to follow a helical path around the annular chamber 64. The annular chamber 64 therefore acts as a low efficiency cyclone.

As stated above the shroud 68 acts as a fluid outlet for the annular chamber 64. The shroud 68 has a horseshoe shaped wall 76 and a skirt portion 78 depending from the horseshoe shaped wall 76. The skirt portion 78 also depends from the wall portion 74 which is attached to the shroud 68. The skirt portion 78 tapers outwardly in a direction towards the outer wall 54. A large number of perforations 80 are formed in the shroud 68. The only fluid outlet from the annular chamber 64 is formed by the perforations 80 in the shroud 68. A passage 82 is formed between the shroud 68 and the second cylindrical wall 62. The passage 82 communicates with a plurality of second stage cyclones 84 via a plenum chamber 85.

The second stage cyclones 84 are arranged in two layers, a first layer 86 and a second layer 88 which is arranged above the first layer 86. These second stage cyclones 84 are arranged to have a parallel airflow through them. The second stage cyclones 84 in each layer 86, 88 are arranged circumferentially around the plenum chamber 85. Each second stage cyclone 84 has a tangential inlet 90 which communicates with the plenum chamber 85. Each second stage cyclone 84 is identical to the other second stage cyclones 84 and comprises a cylindrical upper portion 92 and a tapering portion 94 depending therefrom. The tapering portion 94 of each second stage cyclone 84 is frustro-conical in shape and terminates in a cone opening 96. The second stage cyclones 84 extend into and communicate with the cylindrical chamber 67 bounded by the second cylindrical wall 62. This cylindrical chamber 67 acts as dust collector for dust separated by the second stage cyclones 84. A vortex finder 98 is provided at the upper end of each second stage cyclone 84 to allow air to exit the second stage cyclones 84. Each vortex finder 98 communicates with an outlet duct 100 which passes between the second stage cyclones 84 to provide a clean air outlet 102 located on a side surface of the separating apparatus 4. When the separating apparatus 4 is docked on the rolling assembly 6 the clean air outlet 102 is hidden from view and connects with a suction source inlet duct 104.

In the preferred embodiment there are twenty eight second stage cyclones 84 arranged in two layers 86, 88 of fourteen second stage cyclones 84. Each set of fourteen second stage cyclones 84 are arranged in a ring which is centred on a longitudinal axis X1 of the outer bin 52. Each second stage cyclone 84 has an axis C which is inclined downwardly and towards the axis X1. The axes C may all be inclined to the axis X1 at the same angle or alternatively the second stage cyclones 84 in the first layer 86 may be inclined to the X1 axis at a different angle to the second stage cyclones 84 in the second layer 88. The second stage cyclones 84 can be considered to form a second cyclonic separating unit, with the annular chamber 64 forming the first low efficiency cyclonic separating unit.

In the second cyclonic separating unit, each second stage cyclone 84 has a smaller diameter than the annular chamber 64 and so the second cyclonic separating unit is capable of separating finer dirt and dust particles than the first cyclonic separating unit. It also has the added advantage of being challenged with an airflow which has already been cleaned by the first cyclonic separating unit and so the quantity and average size of entrained particles is smaller than would otherwise have been the case. The separation efficiency of the second cyclonic separating unit is higher than that of the first cyclonic separating unit.

As stated above the main body 8 of the rolling assembly 6 comprises a suction source 50 which is in the form of a motor-driven fan unit. The main body 8 also comprises a cable rewind assembly 106 for retracting and storing within the main body 8 a portion of an electrical cable providing electrical power to the motor of the fan unit 50. The fan unit 50 comprises a motor, and an impeller driven by the motor to drawn the dirt-bearing airflow into and through the vacuum cleaner 1. The fan unit 50 is housed in a motor bucket 108. The motor bucket 108 is connected to the main body 8 so that the fan unit 50 does not rotate as the vacuum cleaner 1 is maneuvered over a floor surface. A post motor filter assembly 110 is located in the main body 8 around and above the suction source 50. The post motor filter assembly 110 is horseshoe shaped such that it can wrap around the motor bucket 108 making the most of the space inside the rolling assembly 6. A plurality of perforations are formed in a portion of the motor bucket 108 surrounded by the post motor filter assembly 110. A seal 112 separates the cable rewind assembly 106 from the motor bucket 108.

The main body 8 further comprises an air exhaust port 114 for exhausting cleaned air from the vacuum cleaner 1. This can be seen best in FIG. 7. The exhaust port 114 is formed in the side surfaces 20 of the main body 8 such that when the wheels 10, 12 are in place the exhaust port 114 is hidden from view but exhausted air can seep out from between the side surfaces 20 of the main body 8 and the inner surfaces 22 of the wheels 10, 12. In a preferred embodiment the exhaust port 114 comprises a number of outlet holes 116. In an alternative embodiment an exhaust port 114 may be provided on another part of the main body. In FIG. 10 an exhaust port 114 has been positioned on the outer surface 30 of the main body 8.

In use, the fan unit 50 is activated by the user, for example by pressing a button 118 located on the upper surface of the main body 8 of the rolling assembly 6. This causes a dirt-bearing airflow to be drawn into the vacuum cleaner 1 through the suction opening 46 in the cleaner head 44. The dirt-bearing air passes through the hose 38 and wand assembly 42, and enters the inlet duct 48 via the swivel joint 47. The dirt-bearing air then passes into the dirty air inlet duct 70 of the separating apparatus 4. Due to the tangential arrangement of the end 72 of the dirty air inlet duct 70, the airflow follows a helical path relative to the outer wall 54. Larger dirt and dust particles are deposited by cyclonic action in the annular chamber 64 and collected therein.

The partially-cleaned airflow exits the annular chamber 64 via the perforations 80 in the shroud 68 and enters the passage 82. The airflow then passes into the plenum chamber 85 and from there into the second stage cyclones 84 via their inlets 90 wherein further cyclonic separation removes some of the dirt and dust still entrained within the airflow. This dirt and dust is deposited in the cylindrical chamber 67 whilst the cleaned air exits the second stage cyclones 84 via the vortex finders 98 and enters the outlet duct 100. The airflow then passes into the main body 8 of the rolling assembly 6 through the suction source inlet duct 104.

The inlet duct 104 guides the airflow into the fan unit 50. The airflow is exhausted from the motor exhaust ducts into the motor bucket 108. The airflow then passes out of the motor bucket 108 and passes through the post motor filter assembly 110. Finally the airflow follows the curvature of the main body 8 to the outlet holes 116 of the exhaust port 114, from which the cleaned airflow is ejected from the vacuum cleaner 1.

The separating apparatus 4 comprises a handle 24 for facilitating the removal of the separating apparatus 4 from the vacuum cleaner 1. To enable the separating apparatus 4 to be removed from the vacuum cleaner 1 for emptying, the user depresses a catch release button 120 to release the handle 24 from a handle catch 122 on the main body. The handle catch 122 during normal use keeps the separating apparatus 4 attached to the main body 8. Any suitable handle catch and catch release button could be used.

To enable the collected dirt and dust to be emptied from the separating apparatus 4, the user removes the separating apparatus 4 from the vacuum cleaner 1. While holding the separating apparatus 4 by the handle 24, the user depresses the button 120 which causes a rod to push against catch 58. The downward pressure thus applied to the catch 58 causes the catch 58 to move away from the lip 60 on the outer wall 54 of the outer bin 52, allowing the base 56 to drop away from the outer wall 54 so that dirt and dust collected within the separating apparatus 4 can be removed therefrom.

The flexible hose 38 comprises a hose cuff 124 which sealingly engages with a connector 126 of the swivel joint 47. The connector 126 is a rotatable connector and is arranged to sealingly rotate about an axis X2 which is parallel with at least a first portion 128 of the inlet duct 48. In order to allow this rotation, the connector 126 is able to rotate about the first portion 128, or about a first portion cuff 130 which is fixed to the start of the inlet duct 48. This arrangement ensures that during use, if a user tugs the hose 38 and wand assembly 42 in a particular direction, the swivel joint 47 will allow the connector 126 to swivel about the inlet duct 48 ensuring that the vacuum cleaner has greater stability than if the joint were fixed.

As mentioned above it can be seen in FIGS. 8 to 10 that the recess 18 comprises a number of shaped recesses 36. The shaped recesses 36 are shaped to accommodate correspondingly shaped second stage cyclones 84, such that each second stage cyclone 84 which is hidden from view when the separating apparatus 4 is received on the rolling assembly 6 is received within a shaped recesses 36 which closely matches its external shape. In the embodiments shown there are therefore two rows of shaped recesses 36 which correspond to the first and second layers 86, 88 of second stage cyclones 84.

Figure 4:
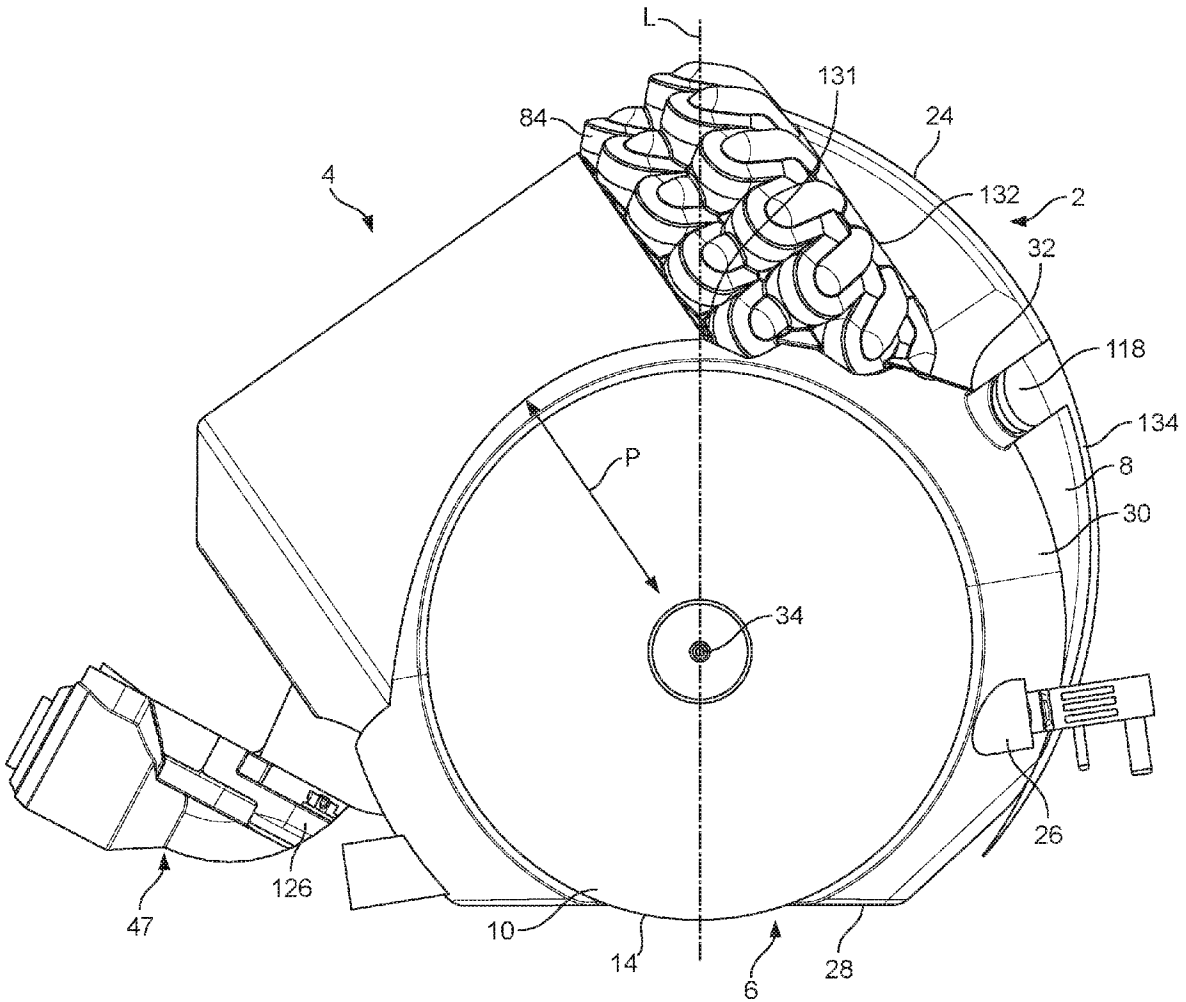
FIG. 4 is a side view of the body of the vacuum cleaner.
Figure 5:
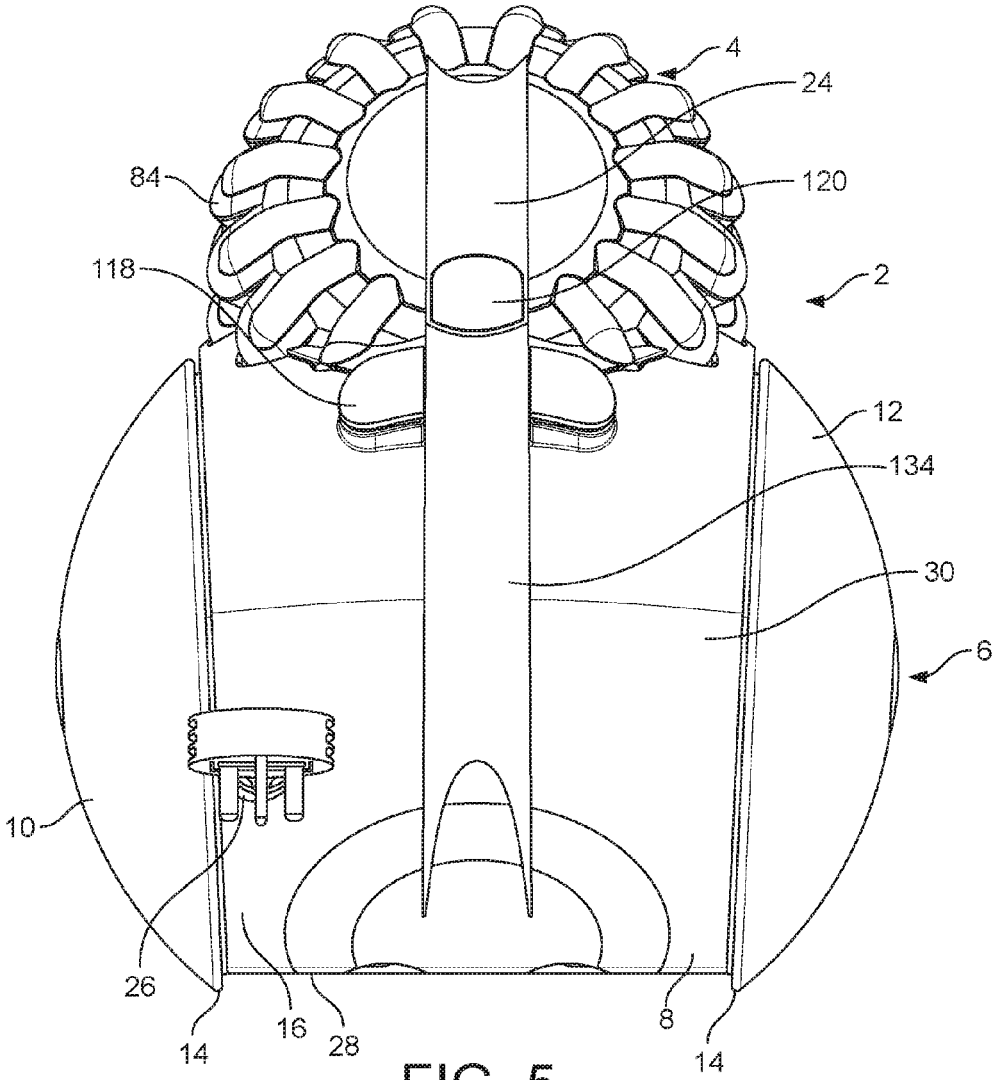
FIG. 5 is a rear view of the body of the vacuum cleaner.
Figure 6:
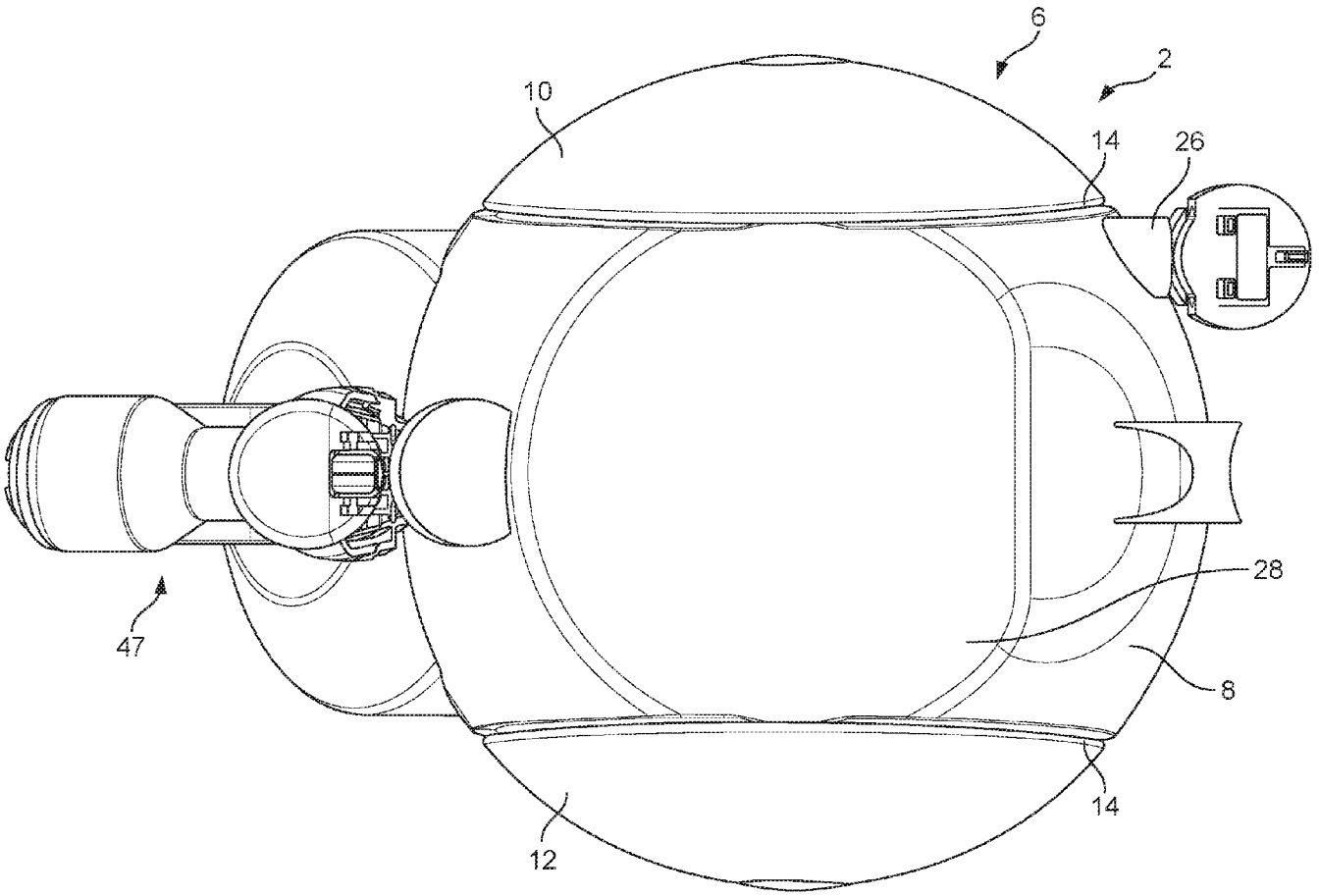
FIG. 6 is an underside view of the body of the vacuum cleaner.
Figure 14:
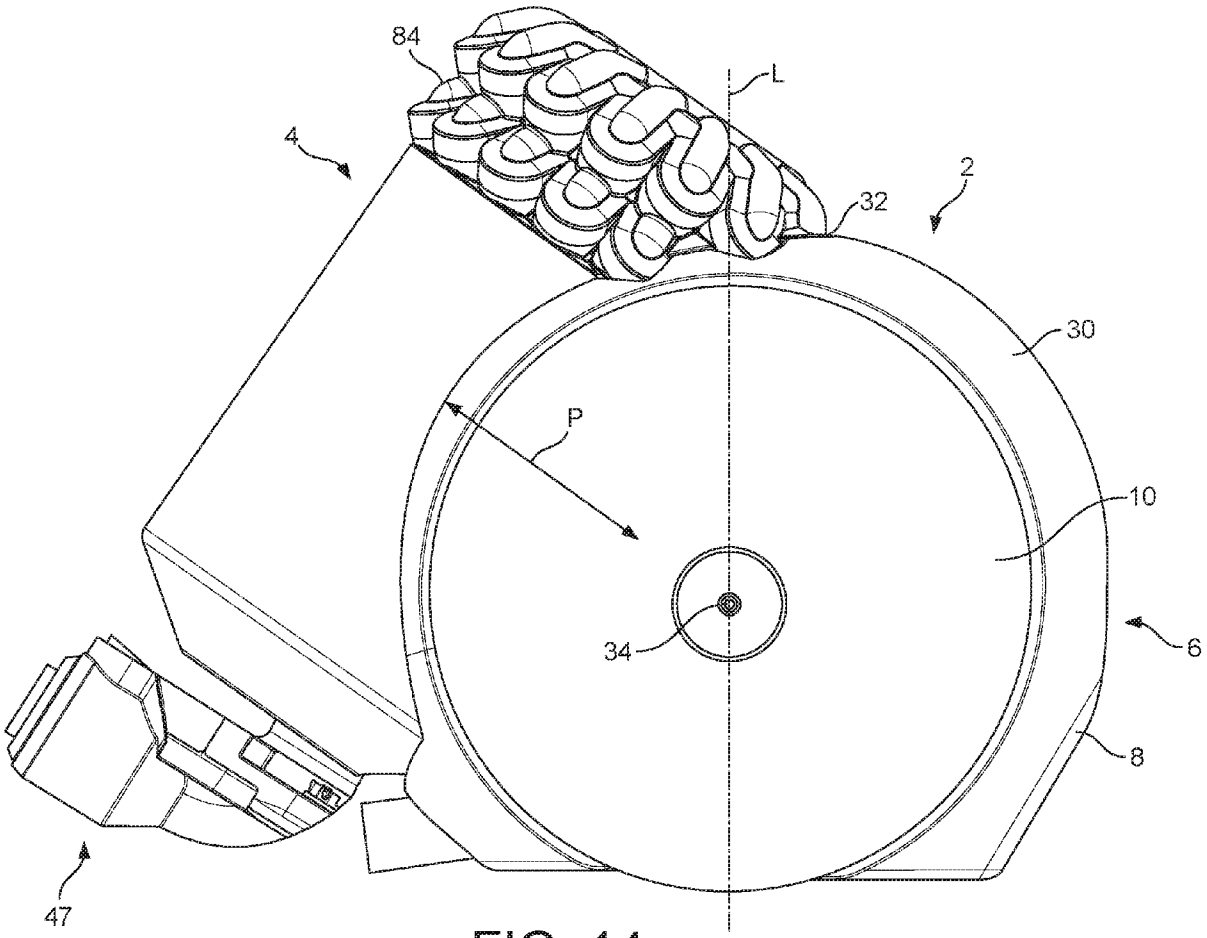
FIG. 14 is a side view of a second embodiment showing the body of the vacuum cleaner.
Figure 15:
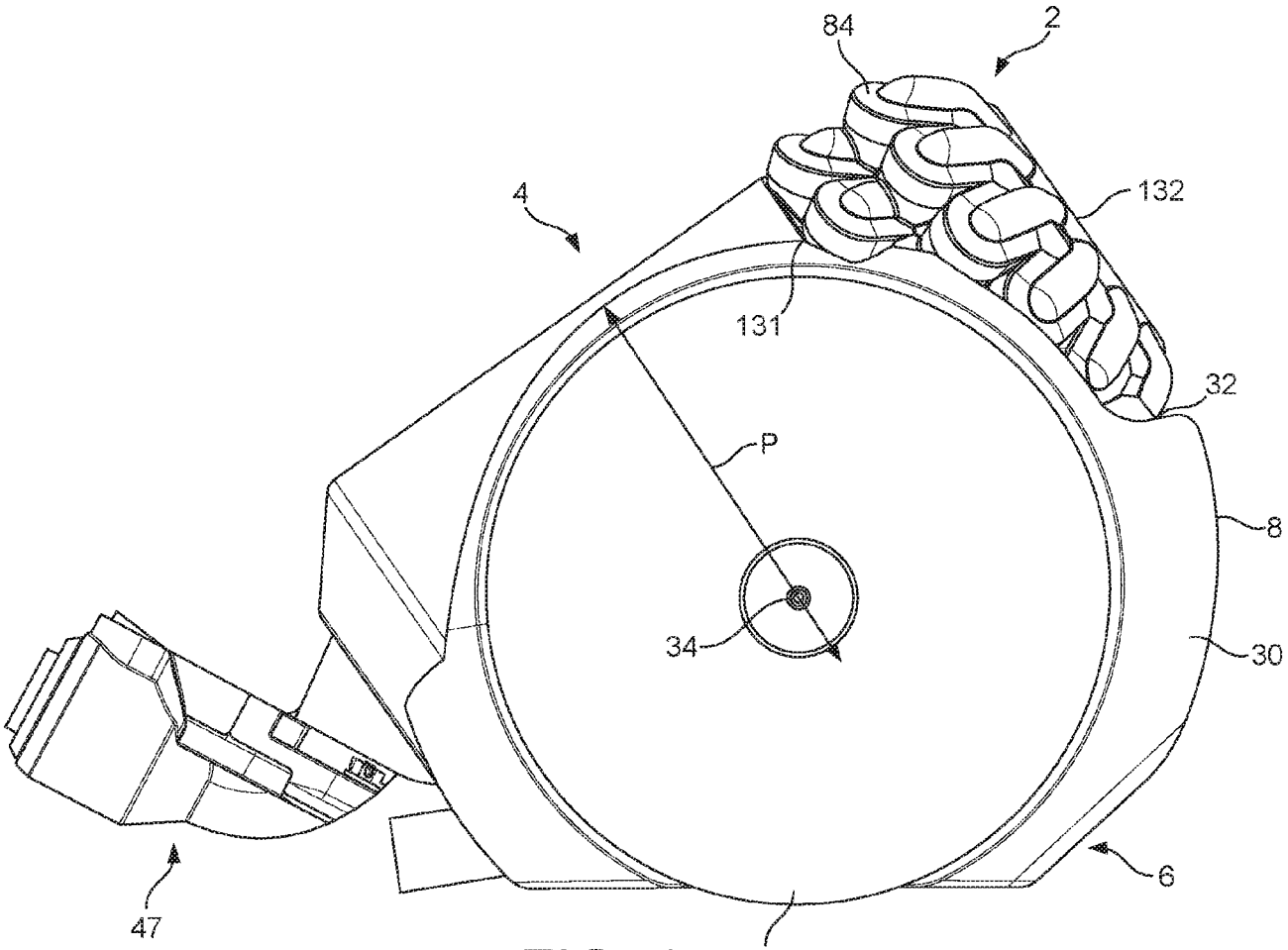
FIG. 15 is a side view of a third embodiment showing the body of the vacuum cleaner.

It can be seen in FIG. 14 and FIG. 15 that different amounts of separating apparatus 4 can be hidden from view when the separating apparatus 4 is received or docked within the recess 18 of the rolling assembly 6. In FIG. 14 it can be seen that when the vacuum cleaner 1 is viewed from the side, at the point of maximum depth (P) of the recess 18, at least one fifth of the width of the low efficiency cyclone (annular chamber 64) is hidden from view by a portion of the rolling assembly 6. In FIG. 15 the proportion of the low efficiency cyclone which is hidden from view is much larger, in this case over four fifths. A preferred embodiment is shown in FIG. 4 where it can be seen that at the point of maximum depth (P) of the recess 18, at least half of the width of the low efficiency cyclone (annular chamber 64) is hidden from view by a portion of the rolling assembly 6.

As discussed previously it can be seen that the most rearward point 32 of the separating apparatus 4 is arranged in line with or rearward of a vertical line L which dissects the centre point 34 of the wheels 10, 12. In general the handle 24 is not being considered as part of the separating apparatus in respect to this feature. In preferred embodiments as shown in FIGS. 4 and 15 the most rearward visible point 131 (when the separating apparatus is received in the rolling assembly 6) of the low efficiency cyclone is arranged in line with or rearward of the line L. In other words point 131 is the point at which the top of the outer wall 54 of the low efficiency cyclone meets the second stage cyclones 84 as it intersects the rolling assembly 6. Preferably the top edge 132 of the second cyclonic stage is coincident with the curved surface 16 of the main body 8. Again this can be seen on FIGS. 4 and 15.

The main body 8 may also comprise a second handle 134 which is coincident with the handle 24 to form a smooth curved surface when the separating apparatus 4 is received within the rolling assembly 6. This second handle 134 is also curved such that it does not provide a barrier to the rolling assembly 6 rolling. This means that if the separating apparatus is tipped backwards it will not get stuck and will be able to self right.

The invention is not limited to the detailed description given above. Variations will be apparent to the person skilled in the art.

The invention claimed is:

1. A self-righting cleaning appliance of the cylinder type comprising a cyclonic separating apparatus for separating dirt from a dirt-bearing fluid flow, the cyclonic separating apparatus having a first cyclonic separation unit comprising a low efficiency cyclone and a second cyclonic separation unit comprising a plurality of second cyclones, a floor-engaging rolling assembly configured to roll on a side surface when the cleaning appliance is tipped over from an upright position, the rolling assembly comprising a main body and a pair of floor-engaging wheels, the main body having a recess in which the cyclonic separating apparatus is received such that when the cleaning appliance is viewed from either side there is no gap between the first cyclonic separation unit and the rolling assembly along at least 50 to 100% of the full length of the low efficiency cyclone, wherein the cleaning appliance is arranged so that it is urged to return to an upright position if it is tipped onto its side.

2. The cleaning appliance of claim 1, wherein when the cleaning appliance is viewed from either side and the separating apparatus is received in the recess, there is no gap between the second cyclonic separation unit and the rolling assembly along at least 50 to 100% of the full length of the second cyclonic separation unit.

3. The cleaning appliance of claim 1, wherein when the cleaning appliance is viewed from either side and the separating apparatus is received in the recess, there is no gap between the separating apparatus and the rolling assembly.

4. The cleaning appliance of claim 1, wherein when the cleaning appliance is viewed from either side and the separating apparatus is received in the recess, at least one fifth of the width of the low efficiency cyclone is hidden from view by a portion of the rolling assembly at the point of maximum depth of the recess.

5. The cleaning appliance of claim 1, wherein when the cleaning appliance is viewed from either side and the separating apparatus is received in the recess, a portion of the second cyclonic separation unit is hidden from view by a portion of the rolling assembly.

6. The cleaning appliance of claim 1, wherein the wheels are arranged one on each side of the main body.

7. The cleaning appliance of claim 1, wherein the rotational axes of the wheels are inclined upwardly with respect to a floor surface upon which the cleaning appliance is located.

8. The cleaning appliance of claim 1, wherein each wheel has a domed outer surface.

9. The cleaning appliance of claim 1, wherein the first cyclonic separation unit is arranged upstream of the second cyclonic separation unit.

10. The cleaning appliance of claim 1, wherein the rolling assembly is substantially spheroid or spherical in shape.

11. The cleaning appliance of claim 10, wherein the rolling assembly has one or more protrusions, recesses, cut outs or flat portions but remains substantially spheroid or spherical in shape.

12. The cleaning appliance of claim 1, wherein the cyclonic separating apparatus is removably received within the recess.

13. The cleaning appliance of claim 1, wherein the longitudinal axis of the cyclonic separating apparatus is inclined when it is received in the recess such that it lies at an angle in the range of from 0° to 60° from vertical.

* * * * *